US005090775A

United States Patent [19]

Berger

[11] Patent Number: 5,090,775

[45] Date of Patent: Feb. 25, 1992

[54] METHOD OF MONITORING AND CONTROLLING MINING OPERATIONS

[75] Inventor: Karl-Heinz Berger, Herten-Langenbochum, Fed. Rep. of Germany

[73] Assignee: Bochumer Eisenhutte Heintzmann GmbH & Co. KG, Bochum, Fed. Rep. of Germany

[21] Appl. No.: 624,222

[22] Filed: Dec. 4, 1990

[30] Foreign Application Priority Data

Dec. 14, 1989 [DE] Fed. Rep. of Germany ..... 3941290

[51] Int. Cl.[5] ..... E21F 17/18; G08B 3/10

[52] U.S. Cl. ..... 299/1; 340/683; 367/198

[58] Field of Search ..... 367/197, 198, 199; 340/566, 679, 683; 299/1, 30

[56] References Cited

U.S. PATENT DOCUMENTS 3,489,241 1/1970 Steinberg ..... 340/683 X
4,366,544 12/1982 Shima et al. ..... 340/683 X
4,758,964 7/1988 Bittner et al. ..... 340/683 X

FOREIGN PATENT DOCUMENTS 66418 12/1982 European Pat. Off. ..... 299/30

*Primary Examiner*—David J. Bagnell
*Attorney, Agent, or Firm*—Herbert Dubno

[57] ABSTRACT

The noise spectrum in a mining chamber is captured by at least one microphone and is digitized and filtered to separate an operation-typical pattern from an operation atypical pattern. The operation atypical pattern is compared with reference patterns to establish the malfunction or vocal command or emergency and the apparatus is automatically operated in response thereto.

4 Claims, 2 Drawing Sheets

METHOD OF MONITORING AND CONTROLLING MINING OPERATIONS

FIELD OF THE INVENTION

My present invention relates to a method of monitoring and controlling mining operations in a subterranean structure, e.g. in the formation of a mine gallery and particularly in the mining of coal or the like in a seam, for example, in longwall mining. The invention also relates to a monitoring and control device for carrying out this method and, more specifically, to a device for monitoring a mining operation which involves cutting away a subterranean structure in a mine chamber.

BACKGROUND OF THE INVENTION

Mining operations can involve, inter alia, the use of machines arrayed, for example, along a long-wall mining face for cutting away the subterranean structure in a mine chamber or gallery to advance the chamber and allow recovery of the coal, rock or other material which is thus cut away. In typical long wall mining, for example, a plurality of cutters are arranged along the mining face and are advanced gradually or in steps, individually or in gaps, or in other controlled patterns to maintain the mining operation. The rock, coal or other mined material is carried away by conveyors and generally the machine or machines have facilities enabling them to be controlled by on-site operators.

Control of the operation is effected in various ways. For example, measuring devices can be provided for the resistance of the structure to attack by the mining machines, systems can be provided to monitor tool temperatures and various safety systems may be provided to prevent overloading of the machines. All of these systems, however, utilize very specialized parameters which may respond to some conditions and not others and cannot be used as generalized parameters for the effectiveness of the mining operation.

OBJECTS OF THE INVENTION

It is the principal object of this invention to provide an improved method of monitoring and controlling mining operations whereby drawbacks of earlier systems can be avoided and which effectively allows a generalized control, responsive to a variety of factors.

Another object of the invention is to provide a relatively simple and effective mining-safety method.

Still another object of the invention is to provide a monitoring and control device which will allow improved mine safety and improved efficiency of mining operations.

SUMMARY OF THE INVENTION

These drawbacks and others which will become apparent hereinafter are attained, in accordance with the invention in a method which captures and responds to the noise spectrum in the mine chamber. I have discovered quite surprisingly that, utilizing the total noise spectrum in a mine chamber as an input parameter, improved control of the mining machinery and an improved response of the entire mining operation can be obtained since the noise spectrum contains information as to all types of malfunctions which may arise, including some which cannot be detected by any other means. The detection of the noise spectrum, moreover, allows a shout or warning from a machine operator, made spontaneously or intentionally, to be readily used to terminate operation of the machinery and/or to sound an alarm or otherwise trigger a response. The prior art techniques which have been described do not detect and evaluate the noise spectrum in a mining chamber.

According to the invention, therefore, the noise spectrum is picked up in the mining chamber by at least one microphone and is converted in an electronic converter into digital signals. The digital signals are decomposed with the aid of a filter into operation-typical and operation-atypical noise patterns and the operation-typical noise patterns are supplied to an electronic comparator to which at least one reference pattern can be supplied from a storage or memory, the reference patterns representing specific information as to the possible defect causing the atypical noise pattern. With sufficient agreement between the stored reference pattern and the atypical pattern instantaneously derived, a control, command or other response signal can be emitted.

Preferably, according to the invention, the digital signals detected by the microphone are permanently stored to establish an operation-typical noise pattern which is inputted to the filter to allow the operation atypical noise pattern to be detected. The atypical noise pattern can also be stored to represent the malfunction or unusual status which may have given rise thereto.

More specifically, a method of monitoring a mining operation can comprise the steps of:

(a) cutting away a subterranean structure in a mine chamber;

(b) picking up a noise spectrum in the mine chamber with at least one microphone to produce an electrical signal representing the noise spectrum;

(c) converting the electrical signal representing the noise spectrum into digital signals;

(d) filtering the digital signals to distinguish operation-typical signals from operation-atypical signals;

(e) electronically comparing the operation-atypical signals with previously stored reference patterns of digital signals representing a plurality of atypical operating conditions and thereby determining the occurrence of an atypical operating condition represented by the operation-atypical signals; and (f) outputting a response signal in response to the electronic comparison of step (e).

The operation of a mining machine can be controlled directly with the response signal and/or the response signal may be used to alert personnel of the mine.

The operation atypical noise patterns which are detected can represent processes which are unusual, undesirable and detrimental in the mining operation and which give rise to noise. For example the knocking of machine parts, a whine where a driven part breaks away from its driver, and a variety of impacts, vibrations and squeals which are common place when a machine breakdown occurs or is about to occur.

According to the invention, the operation-atypical noises that can trigger a response can include emergency calls or shouts, verbal commands or the like emanating from the machine operators or operating personnel, the oral expressions being picked up by the microphone as operation-atypical sounds, converted to digital signals and compared in the electronic comparator with a variety of command or emergency reference calls which have been previously stored in memory so that with sufficient agreement of the detected call and a reference pattern, corresponding information will be obtainable to effect a control command or alert mine personnel by the response signal described.

A device for monitoring a mining operation involving cutting away of a subterranean structure in a mine chamber can comprise, according to the invention:

at least one microphone in the chamber for picking up a noise spectrum in the mine chamber to produce an electrical signal representing the noise spectrum;

an electronic converter connected to the microphone for converting the electrical signal representing the noise spectrum into digital signals;

filter means connected to the electronic converter for filtering the digital signals to distinguish operation-typical signals from operation-atypical signals; and a comparator connected to the filter means for electronically comparing the operation-atypical signals with previously stored reference patterns of digital signals representing a plurality of atypical operating conditions and thereby determining the occurrence of an atypical operating condition represented by the operation-atypical signals and outputting a response signal in response to the electronic comparison of the comparator.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 2:
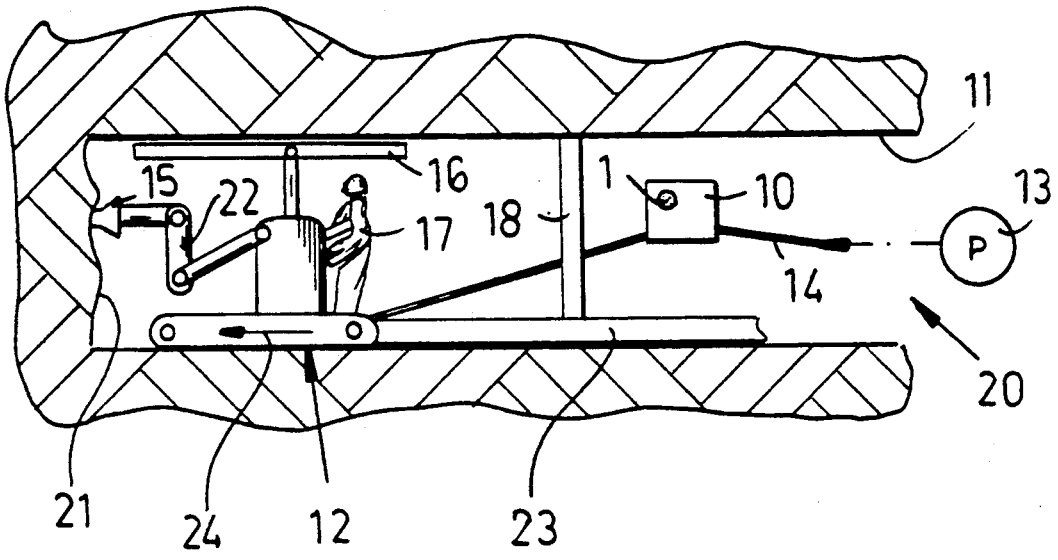
FIG. 2 is a diagrammatic section through a long wall mining system illustrating principles of the invention with the mining machinery being shown in the most diagrammatic form possible.

Referring first to FIG. 2 it will be apparent that a mining operation in a gallery or mining chamber 20 can be carried out with mining machinery represented at 12 which can be arrayed along a mine face 21 extending perpendicular to the plane of the paper in FIG. 2, the mining machining having a large number of excavating heads 15 on arms 22 which can cut away the mining face 21 to produce a mine rubble which can be carried by a conveyor 23 to the rear of the gallery. At spaced apart locations struts 18 are provided to support the roof 11 of the mine. The mining apparatus 12 can move toward the wall in the direction of the arrow 24 in a controlled manner, a shield 16 can be provided on the machine in the otherwise unsupported portion of the gallery roof at which mining is underway for an operator 17 can be provided to control the machinery as has been shown in highly diagrammatic form.

Figure 3:
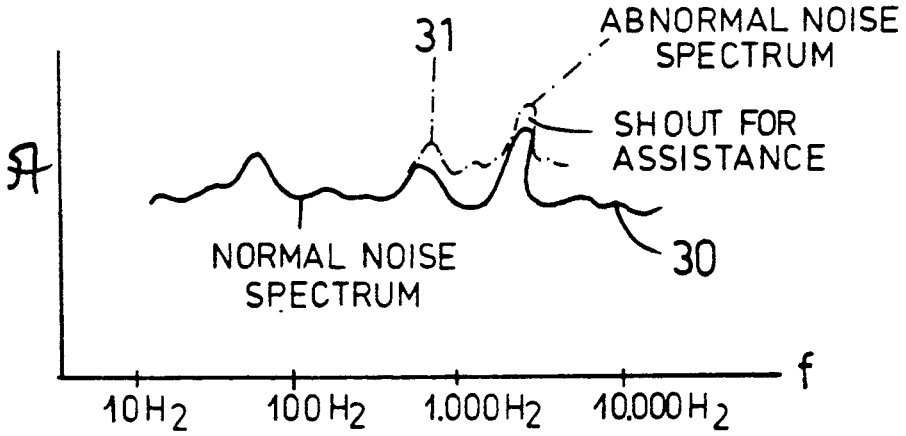
FIG. 3 is a diagram in which amplitude has been plotted against frequency illustrating principles of this invention.

The machinery can by hydraulically controlled and for this purpose, also diagrammatically illustrating the principle, a main hydraulic line 14 from the main hydraulic source 13 can be provided. The monitory and control unit of the invention has been represented at 10 and is located in the mining chamber 20 so that its microphone can pick up the sounds which are produced. Also in diagrammatic form, the analog output of the microphone is plotted in the solid line curve 30 which represents frequency (plotted along the abscissa) as against amplitude (plotted along the ordinate). The plot shown is over a brief time period say of the order of one second. In dot-dash lines at 31 there is shown the noise spectrum upon which an abnormal noise has been superimposed, e.g. in the form of a shout for assistance or a sound introduced by machine failure. While the signals are represented in FIG. 3 in analog form, it will be understood that they are processed, according to the invention, in digital form.

Figure 1:
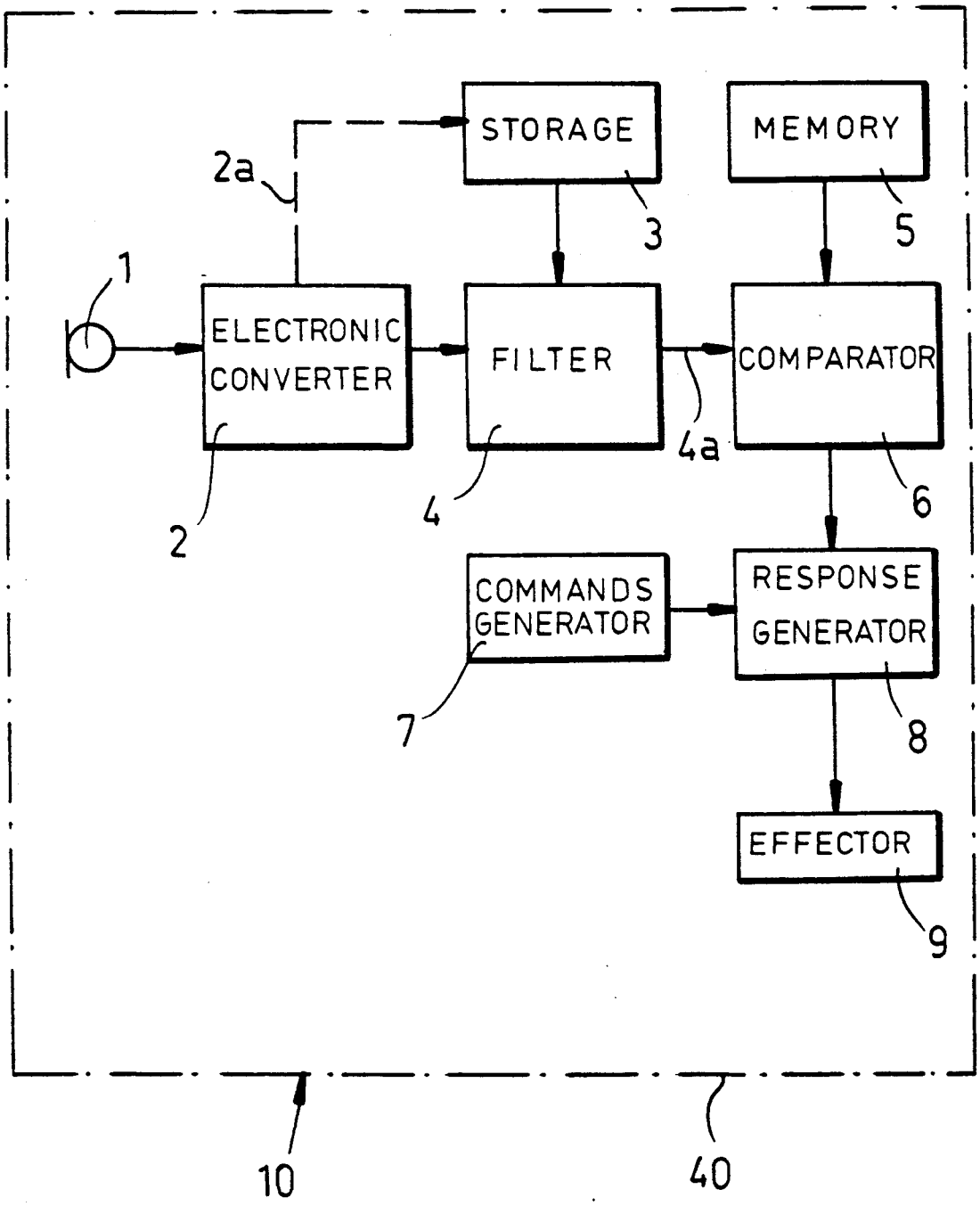
FIG. 1 is a block diagram of an apparatus according to the invention.

Turning now to FIG. 1 it can be seen that the microphone 1 feeds an electronic converter 2 which delivers its digital output to a filter 4 which serves to separate operation-typical sound patterns from operation-atypical sound patterns, the operation-typical sound patterns deriving from a storage or memory 3 which can be supplied with the operation-typical patterns as represented at **2*a*. The output 4*a* from the filter 4 is the operation atypical sound pattern and is supplied to a comparator 6. To this comparator is also supplied from the memory or storage 5** reference patterns representing a variety of conditions which can give rise to the operation atypical sound patterns which are detected. For example, reference patterns of squeals or the like can indicate insufficient machine lubrication. Other patterns may represent calls for assistance or shouts of danger.

With the monitoring and control system as thus far described, therefore, it will be apparent that the noise spectrum in the mining chamber during the mining operation is picked up by the microphone, converted into digital signals in the electronic converter 2 and separated into operation typical and operation atypical noise patterns. With a sufficient agreement between an operation atypical pattern and a reference pattern having a given meaning, a corresponding control command or alert signal can be generated at 8. The control command can directly shut down a machine, sound an alarm, etc. Of course control of the system can be effected by comparing operation typical patterns with previously stored patterns. In that sense, therefore, an operation atypical pattern will be understood to be a pattern which requires a response.

The apparatus can include a device 7 for generating conventional commands and which can be passed, as determined by the response generator 8, usually a microcomputer or other digital control system to an effector 9 such as a magnetic valve which can shut down the supply of power to the machinery. Other effectors can be used and specific effectors can be provided at various points in the machinery to allow control of only parts thereof. A common housing 40 is provided for the parts 1 through 9 of the device 10.

When the apparatus is used for long wall mining, the method and device of the invention can be used to issue stepping commands for the parts of the long wall mining machine, to set into operation individual machine units or to shut them down, etc. Safety in the mine is likewise improved since the machine can respond through the device of the invention to a shout of danger or emergency automatically far more rapidly than can an operator.

I claim:

1. A method of monitoring a mining operation, comprising the steps of:

(a) cutting away a subterranean structure in a mine chamber;

(b) picking up in said mine chamber a noise spectrum which is verbal control information in the form of oral commands or emergency calls with at least one microphone to produce an electrical signal representing said noise spectrum;

(c) converting said electrical signal representing said verbal control information of said noise spectrum into digital signals;

(d) filtering said digital signals to distinguish operation-typical signals from operation-atypical signals;

(e) electronically comparing said operation-atypical signals with previously stored reference information patterns of digital signals representing a plurality of atypical operating conditions and thereby determining the occurrence of an atypical operating condition represented by said operation-atypical signals; and (f) automatically outputting a response signal which is a corresponding control-command or monitoring signal in response to the electronic comparison of step (e).

2. The method defined in claim 1, further comprising the step of controlling operation of a mining machine directly with said response signal.

3. The method defined in claim 1, further comprising the step of alerting personnel of the mine with said response signal.

4. The method defined in claim 1 wherein said digital signals of step (c) are permanently stored as a measure of operation-typical signals.

* * * * *